US006356725B1

(12) United States Patent
Park et al.

(10) Patent No.: US 6,356,725 B1
(45) Date of Patent: Mar. 12, 2002

(54) PHOTOSENSITIVE BELT CARTRIDGE OF A LIQUID ELECTROPHOTOGRAPHIC PRINTER

(75) Inventors: Woo-yong Park; Kwang-ho No, both of Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/658,498

(22) Filed: Sep. 8, 2000

(30) Foreign Application Priority Data

Dec. 2, 1999 (KR) ..... 99-54532

(51) Int. Cl.[7] ..... G03G 15/02
(52) U.S. Cl. ..... 399/116
(58) Field of Search ..... 399/107, 110, 399/116, 159, 162, 164, 165

(56) References Cited

U.S. PATENT DOCUMENTS 5,400,121 A * 3/1995 Foote ..... 399/116
5,708,924 A * 1/1998 Shogren et al. ..... 399/116
6,014,535 A * 1/2000 Zenk et al. ..... 399/116
6,049,682 A * 4/2000 Goetzke et al. ..... 399/116
6,233,415 B1 * 5/2001 Pang ..... 399/116

* cited by examiner

*Primary Examiner*—Sandra Brase
(74) *Attorney, Agent, or Firm*—Sughrue Mion, PLLC

(57) ABSTRACT

A photosensitive belt cartridge includes a cartridge body substantially in the shape of an ovoid whose one end is open to receive the photosensitive belt in an endless track thereto. A plurality of spring plates, whose respective ends are fixed on ends of inner wall of the cartridge body, are arranged on the inner wall of the cartridge body along the endless track of the photosensitive belt at certain intervals, for supporting the photosensitive belt in cooperation with the inner wall of the cartridge body. An inner cover is used which is disposed at an open portion of the cartridge body for supporting edges of the photosensitive belt, and also for supporting the ends of the plurality of spring plates, for preventing partial loosening of the photosensitive belt. Further, the cartridge body includes a guiding rail formed on the upper surface, which has a pair of outwardly-bent locking ribs which are slidably fit into the advancing rail of the belt unit. The inner cover slides into the cartridge body when the inner cover is advanced into the belt unit. Accordingly, since the structure is simplified and the number of parts is reduced, the assembling time and cost can be greatly reduced while manufacturing can be more profitable. Further, the photosensitive belt cartridge is easy to handle, and the photosensitive belt thereof is protected from any possible damage.

7 Claims, 9 Drawing Sheets

PHOTOSENSITIVE BELT CARTRIDGE OF A LIQUID ELECTROPHOTOGRAPHIC PRINTER

BACKGROUND OF THE INVENTION

1. Field of the Invention

The present invention relates to a photosensitive belt cartridge for accommodating a photosensitive belt on an endless track safely until the photosensitive belt is disposed in a liquid electrophotographic printer.

2. Description of the Prior Art

Generally, as shown in FIG. 1, a liquid electrophotographic printer such as, for example, a color laser printer, includes a photosensitive belt 10 which rotatably travels on an endless track while being supported by a plurality of rolls 11, 12, and 13 disposed in a printer body (not shown). The desired image is developed by a developing unit 14 on one side of the photosensitive belt 10, is dried while being passed through the drying unit 15, and is then transferred onto a printed medium 1 at a transfer/fixing unit 16, which includes a transfer roll 16a and a fixing roll 16b.

Here, the unit in which the photosensitive belt 10 rotatably travels on the endless track will be called a 'belt unit'. Roll 11 is a drive roll connected to a driving source (not shown) for rotating the photosensitive belt 10, roll 12 is a back-up roll of the transfer roll 16a, and roll 13 is a steering roll for preventing skewing of the photosensitive belt 10.

Over time, as the photosensitive belt 10 is used, the accuracy of the image on the photosensitive belt 10 gradually deteriorates. Accordingly, after a certain period of time, the photosensitive belt 10 should be replaced with a new belt in order to produce a clearer image. Conventionally, a user manually replaced the photosensitive belt 10 disposed on the endless track by aligning the photosensitive belt 10 with a corresponding mounting position of the printer body (not shown), i.e., with the belt unit of the printer, and pushing the photosensitive belt 10 into the belt unit using both hands. During such a process, the user moves the steering roll 13, which is movable in a direction as indicated by the double-headed arrow of FIG. 1.

Accordingly, for replacement of the photosensitive belt 10, the user moves the steering roll 13 to the position indicated by the dotted-line of FIG. 1 so as to relax the tension of the photosensitive belt 10, and discards the photosensitive belt 10 from the belt unit. Then, the user inserts a new photosensitive belt 10 into the belt unit, and finally fixes the photosensitive belt 10 at its right position by returning the steering roll 13 to its original position, thereby giving the original tension to the photosensitive belt 10.

Since the shape of the photosensitive belt 10 is not fixed but is flexible, replacing the photosensitive belt 10 by aligning a new photosensitive belt 10 in the right position and inserting the new photosensitive belt 10 by hand is a complicated and bothersome process. Further, the possibility that the user mis-locates the photosensitive belt 10 also cannot be ignored. In addition, since the user is required to place their hands into the printer body (not shown) to discard the used photosensitive belt 10 from the belt unit of the printer body (not shown) by directly grasping the used photosensitive belt 10, the user may be injured by other components in the printer body (not shown).

In order to overcome the above disadvantages found during the replacement of the photosensitive belt 10 using a conventional method, a photosensitive belt cartridge has been suggested. The photosensitive belt cartridge includes a photosensitive belt 10 disposed in an endless track therein, and is advanced to a photosensitive belt mounting position of the printer by being slid along advancing rails formed on the belt unit of the printer, thereby mounting the photosensitive belt 10 accommodated therein to the belt unit. As such, the replacement of the photosensitive belt 10 is simplified, and can be quickly performed.

Such a conventional photosensitive belt cartridge is shown in FIGS. 2 to 5, and is described in greater detail below.

FIG. 2 is a perspective view for showing the appearance of a conventional photosensitive belt cartridge, and FIG. 3 is a rear perspective view of FIG. 2.

As shown in FIGS. 2 and 3, the conventional photosensitive belt cartridge includes a cartridge body 20 in which the photosensitive belt 10 is accommodated in an endless track, and a photosensitive belt supporting section 30 formed along the endless track of the photosensitive belt 10 in the cartridge body 20 at proper intervals, for pressing the photosensitive belt 10 into tight contact with the inner circumference of the cartridge body 20.

The cartridge body 20 is substantially in the shape of a hollow ovoid which has one open end, and accommodates the photosensitive belt 10 in the endless track as in the printer body (not shown). The cartridge body 20 is assembled in a manner that a plate member of a certain size is curved until both opposite ends meet together to form a certain space therein, and a joint of the opposite ends of the plate member is fixed by a plurality of screws 21. A =plurality of various sizes of elevations 22 are formed opposite to the open end of the cartridge body 20. Further, guiding rails 23 and 24 are formed on the upper surface of the cartridge body 20 at certain intervals. The guiding rails 23 and 24 are configured to permit sliding movement along the advancing rails (not shown) of the belt unit of the printer. By the sliding movement of the guiding rails 23 and 24 and the advancing rails (not shown) having such a configuration, the photosensitive belt cartridge is inserted into the exact replacement position of the printer body.

The guiding rails 23 and 24 respectively include a pair of locking ribs 23*a*, 23*b*, 24*a*, and 24*b*, which are locked with and suspended on the advancing rails. Further, the leading ends of the locking ribs 23*a*, 23*b*, 24*a*, and 24*b* are cut away for an easier insertion of the guiding rails 23 and 24 into the advancing rails. After aligning and pressing the cut-away leading ends of the guiding rails 23 and 24 tightly against the lower surface of the advancing rails, by pushing the photosensitive belt cartridge, the locking ribs 23*a*, 23*b*, 24*a*, and 24*b* of the guiding rails 23 and 24 are smoothly fit in into the advancing rails, and thereby the photosensitive belt cartridge is mounted in the printer body (not shown).

As shown in FIG. 5, the photosensitive belt supporting section 30 includes a plurality of magnets 31 buried in the inner wall of the cartridge body 20 along the endless track of the photosensitive belt 10 at certain intervals, and a plurality of plate members 32 having one end fixed on an end of the inner wall of the cartridge body 20, and the other end being magnetically-adhered to the magnets 31, thereby fixedly supporting photosensitive belt 10 in cooperation with the magnets 31. Here, one end of each plate member 32 is fixed on one end 20a of the inner wall of the cartridge body 20 by using pairs of screws 33.

In the conventional photosensitive belt cartridge constructed as described above, the photosensitive belt 10 is safely kept while being fixed between a plurality of magnets 31 and plate members 32. In this conventional cartridge, the photosensitive belt 10 of the printer is replaced using the following method.

The user opens the front door of the printer, discards the used photosensitive belt 10, aligns the guiding rails 23 and 24 of a new photosensitive belt cartridge with the advancing rails of the belt unit, and then pushes in the guiding rails 23 and 24 of the new photosensitive belt cartridge along the advancing rails of the belt unit. As shown in FIG. 1, the steering roll 13 of the belt unit is moved to the position indicated by the dotted line. After completely advancing the photosensitive belt cartridge into the printer body (not shown), the steering roll 13 is returned to its original position. Accordingly, when the photosensitive belt cartridge is pushed out, the photosensitive belt 10 is locked with the respective rolls 11, 12, and 13 of the belt unit so that the photosensitive belt cartridge is pulled out without the photosensitive belt 10.

As described above, by using the photosensitive cartridge, there are advantages in that the photosensitive belt 10 is safely kept, and is replaced when necessary, simply, safely, and quickly.

The above-described conventional photosensitive belt cartridge, however, has disadvantages in that it requires a plurality of components such as screws 21 for fixing the cartridge body 20, other screws 33 for fixing the plate members 32, and the guiding rails 23 and 24 which also have opposing locking ribs 23*a*, 23*b*, 24*a*, and 24*b*, etc., with complicated structure, and considerable manufacturing time and costs, hindering the manufacturing of the photosensitive belt cartridges.

Further, the conventional photosensitive belt cartridge is not easy to handle since there is no proper portion for a user to grasp for handling the photosensitive belt cartridge. Even worse, due to sharp edges of the conventional photosensitive belt cartridge, the user is often injured while handling the photosensitive belt cartridge. The opening end of the cartridge body 20 in particular, is very sharp as shown in FIG. 4. The problems such as folding or cutting of the photosensitive belt 10 during the replacement thereof often occur.

In addition, according to the conventional photosensitive belt cartridge, since the magnets 31 are employed to support the photosensitive belt 10 in the cartridge body 20, the assembling process is difficult, and there could also be quality deterioration of the photosensitive belt 10 due to the presence of the magnets 31.

Further, according to the conventional photosensitive belt cartridge, since the photosensitive belt 10 is supported by a plurality of magnets 31 and the plate members 32 while one end thereof is open, the photosensitive belt cartridge and photosensitive belt 10 can be deformed, and quality thereof can deteriorate. Finally, in the event of careless handling, there is a possibility that the photosensitive belt 10 can accidentally be discarded from the photosensitive belt cartridge.

SUMMARY OF THE INVENTION

The present invention has been developed to overcome the above-mentioned problems of the prior art, and accordingly it is an object of the present invention to provide a photosensitive belt cartridge of a liquid electrophotographic printer suitable for manufacturing by reducing the number of parts and simplifying the shape, and thus reducing the associated manufacturing costs and assembly hours.

Another object of the present invention is to provide a photosensitive belt cartridge of a liquid electrophotographic printer which is easy to handle due to its handle, and which has rounding-treated edges to prevent injury to a user and the photosensitive belt due to sharp edges.

Yet another object of the present invention is to provide a photosensitive belt cartridge of a liquid electrophotographic printer having a photosensitive belt supporting section without requiring a magnet, and thus is easy to assemble, and has no quality deterioration of the photosensitive belt.

Yet another object of the present invention is to provide a photosensitive belt cartridge of a liquid electrophotographic printer capable of preventing deformation of the photosensitive belt cartridge as well as the deformation and quality deterioration of the photosensitive belt which are caused due to partial loosening of the photosensitive belt in the cartridge body.

The above objects are accomplished by a photosensitive belt cartridge accommodating a photosensitive belt mounted in a liquid electrophotographic printer according to the present invention, including: a cartridge body, substantially in the shape of an ovoid, with an open portion to receive the photosensitive belt; a plurality of spring plates, each of the spring plates having a first end fixed on an inner wall of the cartridge body, the plurality of spring plates being arranged on the inner wall of the cartridge body at certain intervals, for supporting the photosensitive belt in cooperation with the inner wall of the cartridge body; and an inner cover disposed at the open portion of the cartridge body for supporting edges of the photosensitive belt and also for supporting a second end of the plurality of spring plates, for preventing partial loosening of the photosensitive belt.

According to a preferred embodiment of the present invention, the cartridge body is assembled in a manner that a certain size plate-shaped member is curved until two opposite ends thereof meet to form a hollow space therein, and then the joint made by the two opposite ends is fixed by at least two clips. Accordingly, compared with the conventional way of using a plurality of screws, the assembling time can be greatly reduced.

Further, the cartridge body includes a handle formed opposite to the open section for a user to grasp, and respective edges of the cartridge body are rounded. Accordingly, the photosensitive belt cartridge becomes easier to use, and the photosensitive belt is protected from any possible damage.

Further, the cartridge body includes a guiding rail formed on the upper surface, which has a pair of outwardly-bent locking ribs which are slidably fit into the advancing rails of the belt unit. The guiding rail includes an inwardly-bent guiding section for an easy advancement into the advancing rails of the belt unit.

The spring plates are inserted into a pair of fixing segments formed in the cartridge body which have inwardly bent sections, respectively. Each spring plate includes a fixing hole at one end, while the cartridge body includes fixing protrusions corresponding to the fixing holes. Accordingly, the spring plates are fixed in the cartridge body. In other words, without having to use separate springs, the spring plates can be simply fixed, shortening the assembling time.

Also, in a preferred embodiment, the inner cover includes guiding grooves corresponding to the respective spring plates of the cartridge body for receiving the spring plates, and supporting protrusions protruding from the middle portions of the respective guiding grooves for supporting the respective spring plates.

Further, the inner cover includes at least six hooks spaced from each other at certain intervals which are inserted into a plurality of holes formed along the open section of the cartridge body, for preventing a complete separation of the inner cover from the cartridge body. The inner cover slides into the cartridge body when the photosensitive belt cartridge is advanced into the belt unit.

BRIEF DESCRIPTION OF THE DRAWINGS

The above and other objects and advantages of the present invention will become readily apparent by reference to the following detailed description when considered in conjunction with the accompanying drawings wherein.

DETAILED DESCRIPTION OF THE PREFERRED EMBODIMENT

Hereinafter, the preferred embodiment of the present invention will be described in greater detail with respect to the accompanying drawings.

Figure 6:
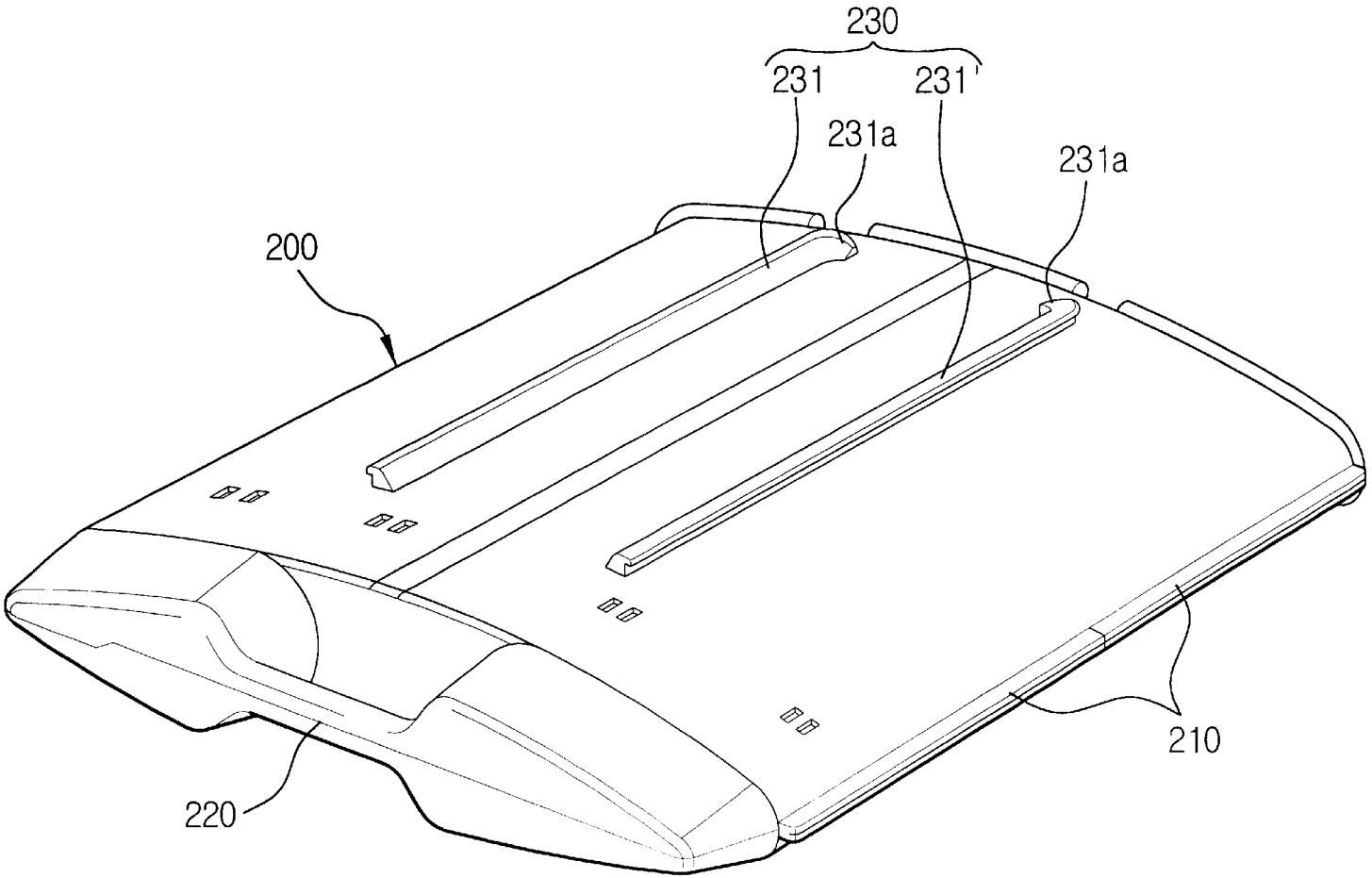
FIG.6 is a perspective view for showing a photosensitive belt cartridge according to a preferred embodiment of the present invention.
Figure 7:
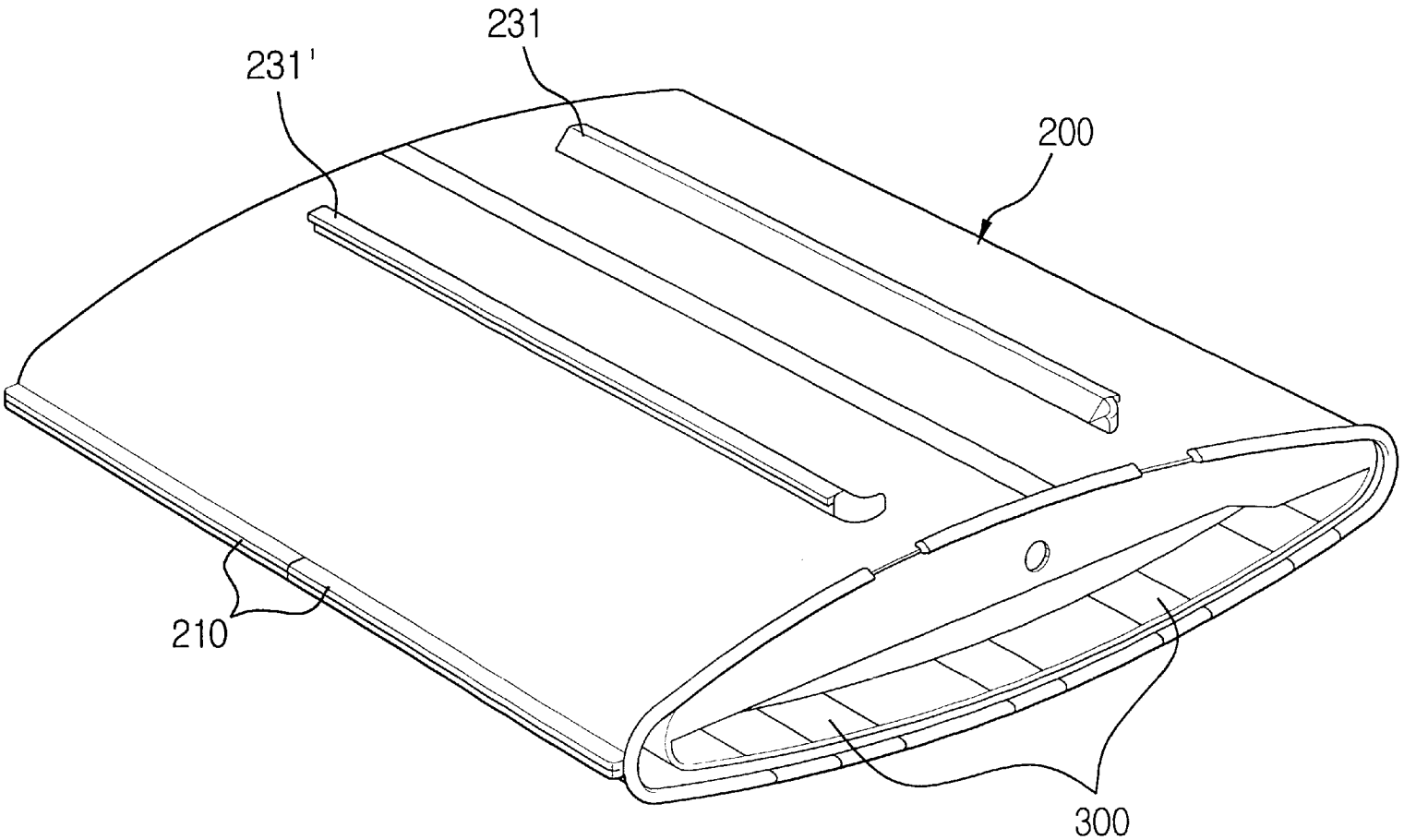
FIG. 7 is a rear perspective view of FIG. 6.
Figure 10:
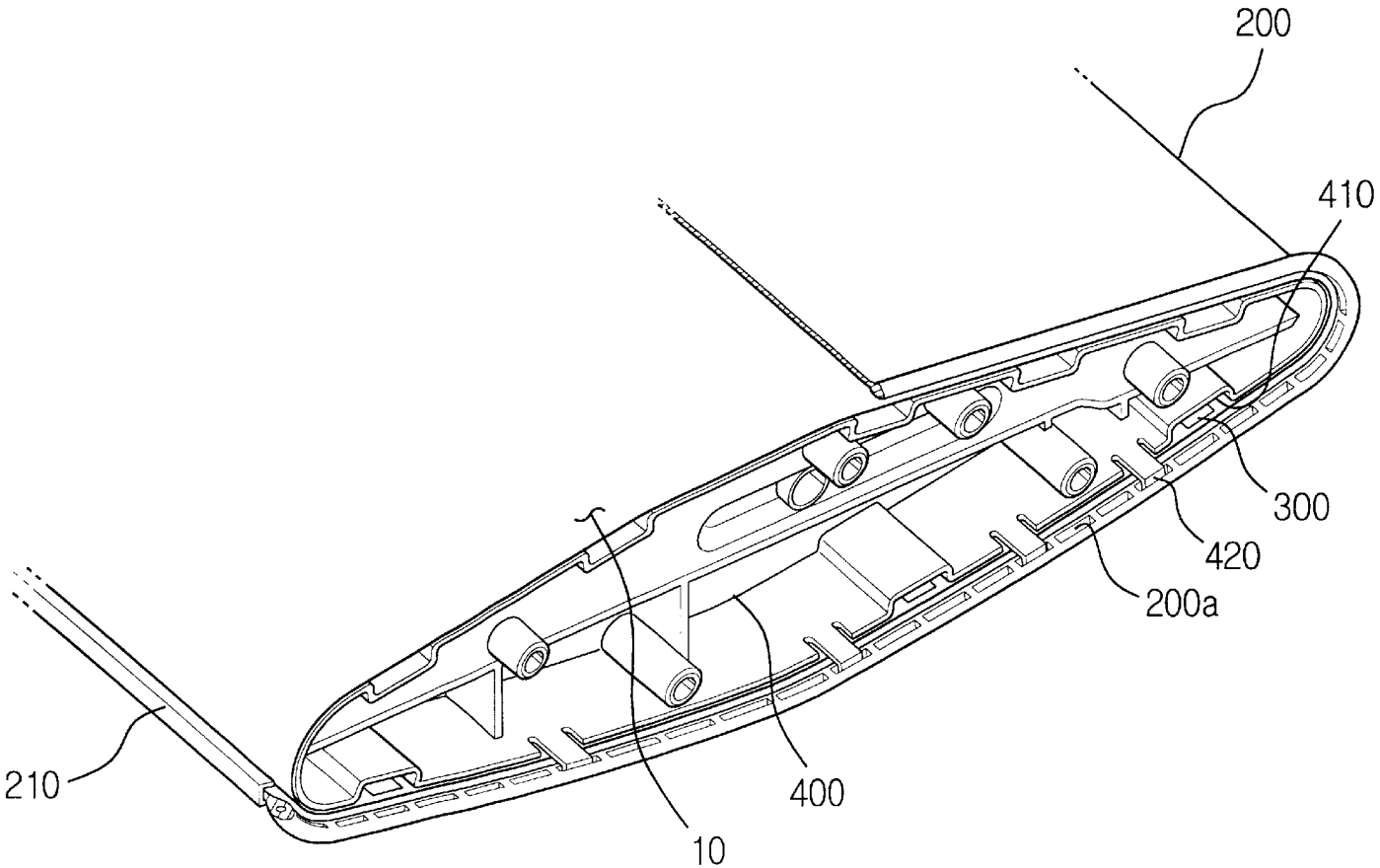
FIG. 10 is a partially cut-away perspective view for showing the main portion of the present invention, i.e., an inner cover being mounted in the open portion of the photosensitive belt cartridge according to the present invention.

As shown in FIGS. 6, 7, and 10, the photosensitive belt cartridge of a liquid electrophotographic printer according to the present invention includes a cartridge body 200 in which the photosensitive belt 10 is accommodated in an endless track, a plurality of spring plates 300 disposed in the cartridge body 200 at proper intervals along the endless track of the photosensitive belt 10 for supporting the photosensitive belt 10 in cooperation with the inner wall of the cartridge body 200, and an inner cover 400 disposed at the open portion of the cartridge body 200, for supporting an outline of the photosensitive belt 10 and ends of a plurality of spring plates 300, thereby preventing partial loosening of the photosensitive belt 10.

The cartridge body 200 is substantially in the shape of a hollow ovoid whose one end is open, and the photosensitive belt 10 is accommodated in the cartridge body 200 in the endless track in the same manner as in the printer body. The cartridge body 200 is assembled in a manner that a plate member of a certain size is curved until opposite ends meet to form a certain space therein, and a joint of opposite ends is fixed by a pair of clips 210. Compared with the conventional case in which a plurality of screws are used to fix opposite two ends of the cartridge body 200, the assembling time can be significantly reduced. Further, the cartridge body 200 includes a handle 220 formed on the cartridge body 200 opposite to the open portion for a user to grasp, and a guiding rail 230 formed on the upper surface which is configured to be slid along advancing rails (not shown) formed on the belt unit of the printer.

Figure 8:
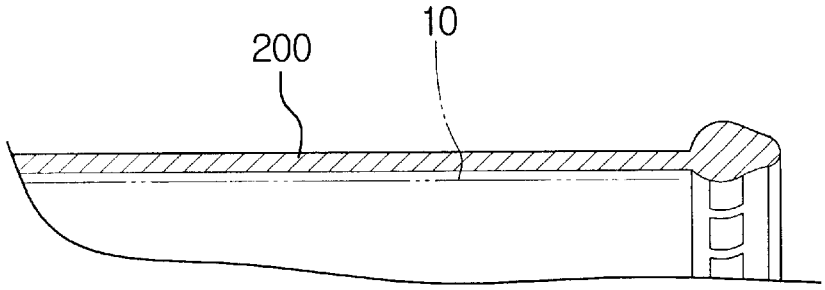
FIG. 8 is a sectional view for partially showing an open end of the photosensitive belt cartridge according to the present invention.

Further, as shown in FIG. 8, in the photosensitive belt cartridge according to the present invention, the respective edges of the cartridge body 200 inclusive of the open portion are rounded. Accordingly, it is easy to handle, and injury to a user or damage to the photosensitive belt 10 can be prevented.

The guiding rail 230, as shown in FIG. 6 includes a pair of outwardly-bent locking ribs 231 and 231' which are spaced from each other at the same interval as the advancing rails of the belt unit. Inwardly bent guiding sections 231*a* are formed on the leading end of the guiding rail 230, for permitting smooth insertion of the guiding rail 230 into the advancing rails. After tightly aligning the guiding sections 231*a* against the lower surface of the advancing rails, the photosensitive belt cartridge is pushed in as the locking ribs 231 and 231' are smoothly fitted in the advancing rails.

Figure 9:
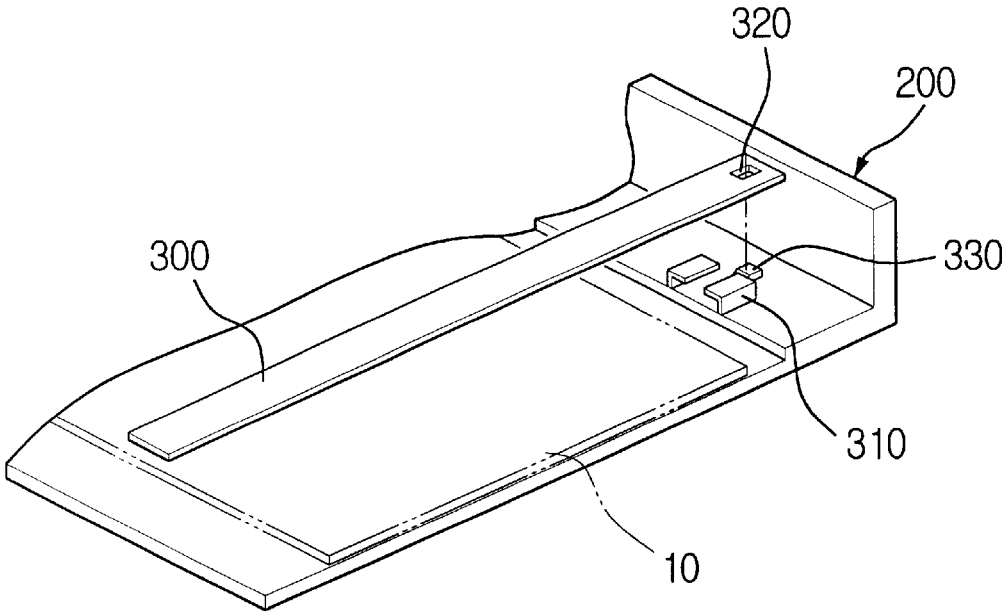
FIG. 9 is a perspective view for showing the fixture structure of a spring plate of the photosensitive belt cartridge according to the present invention.

As shown in FIG. 9, a plurality of spring plates 300 are disposed as the ends thereof are fitted into a pair of inwardly bent fixing pieces 310 formed on the inner wall of the cartridge body 200. A fixing hole 320 is formed on one end of each spring plate 300, while fixing protrusions 330 are formed on the cartridge body 200 corresponding to the fixing holes 320. Accordingly, the spring plates 300 are fixed onto the cartridge body 200, and supporting the photosensitive belt 10 in cooperation with the inner wall of the cartridge body 200. Accordingly, in comparison with the conventional way of fixing by a plurality of screws, the fixing process becomes simplified, and the assembling time can be also reduced.

The inner cover 400 is disposed to prevent possible deformation of the cartridge body 200 which has a hollow ovoid shape whose one end is open, and to prevent deformation of other parts which can be caused due to loosening of the photosensitive belt 10. The inner cover 400 is fit in the open portion of the cartridge body 200. Here, the magnet, which was conventionally used to tightly press the photosensitive belt 10 onto the inner wall of the cartridge body 200, is omitted, and the inner cover 400 replaces the function of the magnet by tightly pressing the photosensitive belt 10 onto the inner wall of the cartridge body 200.

Figure 11:
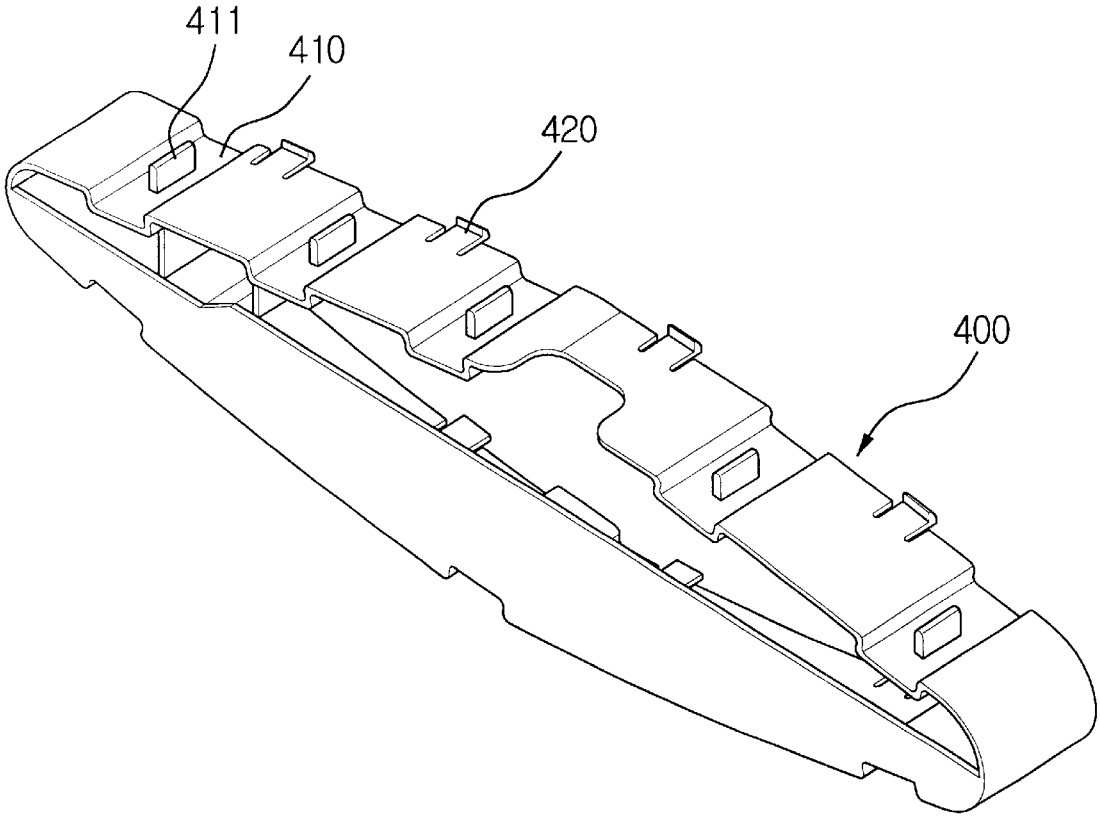
FIG. 11 is a perspective view for partially showing the inner cover of FIG. 10.

As shown in FIGS. 10 and 11, the shape of the inner cover 400 corresponds to the ovoid shape of the cartridge body 200, while being made of the same material as the cartridge body 200, although the materials may vary in other embodiments.

The inner cover 400 includes guiding grooves 410 corresponding to the respective spring plates 300 for receiving the spring plates 300, and supporting protrusions 411 formed on the middle portions of the guiding grooves 410 to press and support the spring plates 300. By such a structure, the inner cover 400 is mounted in the open portion of the cartridge body 200 to support the outline of the photosensitive belt 10 and ends of the spring plates 300, simultaneously.

Further, the inner cover 400 includes at least six hooks 420 formed at certain intervals for being inserted into a plurality of holes 200a which are formed along the open portion of the cartridge body 200. Accordingly, once being mounted in the open portion of the cartridge body 200, the inner cover 400 is never to be separated from the cartridge body 200 accidentally. Meanwhile, when advancing the photosensitive belt cartridge into the belt unit, the inner cover 400 is slid into the cartridge body 200 so as not to hinder the mounting process of the photosensitive belt 10.

Figure 1:
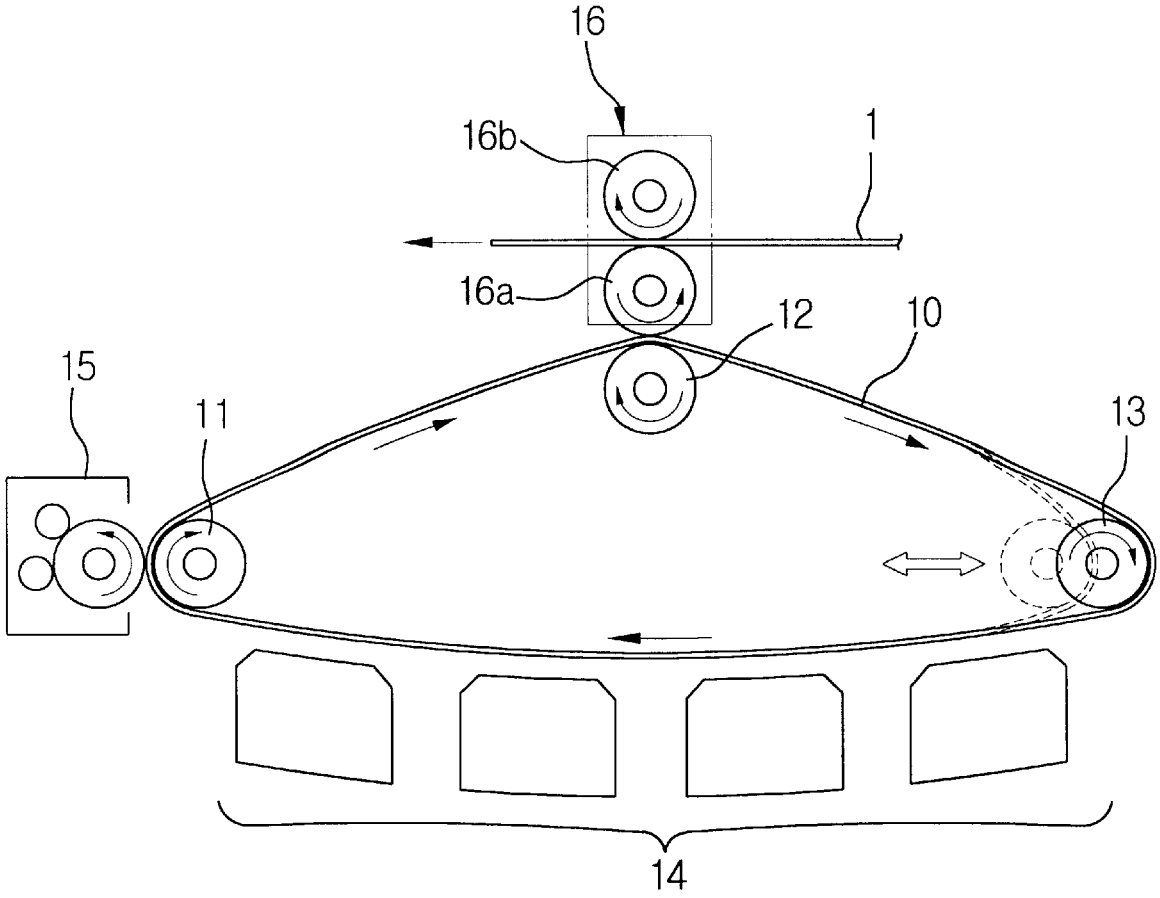
FIG. 1 (PRIOR ART)
FIG. 1 is a schematic view for showing the main portion of a conventional liquid electrophotographic printer.
Figure 2:
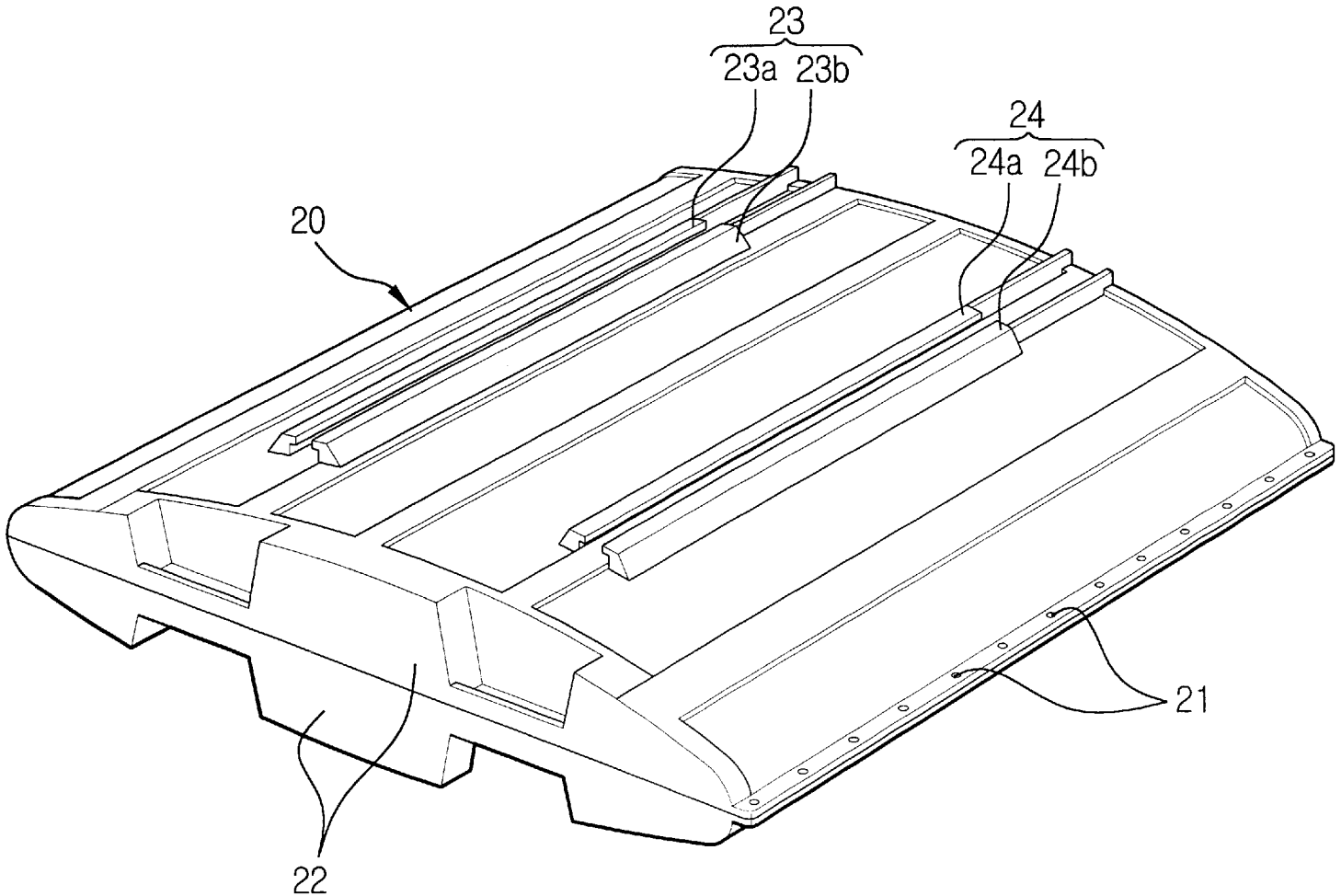
FIG. 2 (PRIOR ART)
FIG. 2 is a perspective view of a conventional photosensitive belt cartridge.
Figure 3:
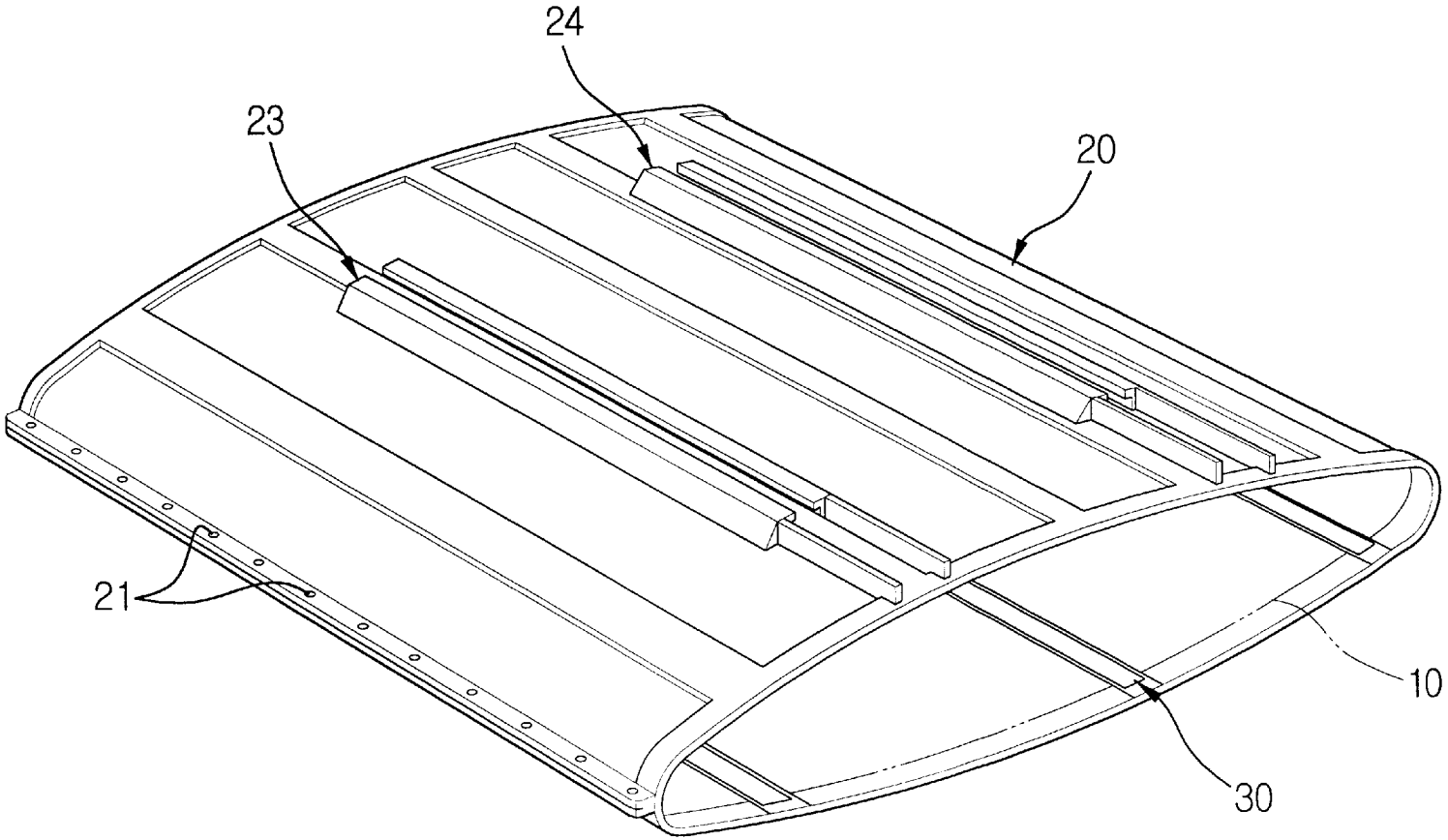
FIG.3 (PRIOR ART)
FIG. 3 is a,rear perspective view of FIG. 2.
Figure 4:
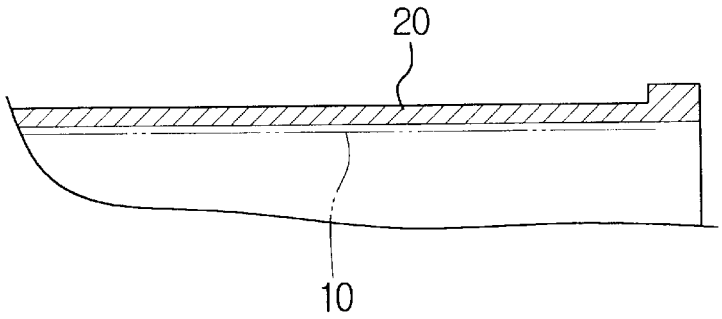
FIG.4 (PRIOR ART)
FIG. 4 is a sectional view for partially showing an open end of the conventional photosensitive belt cartridge.
Figure 5:
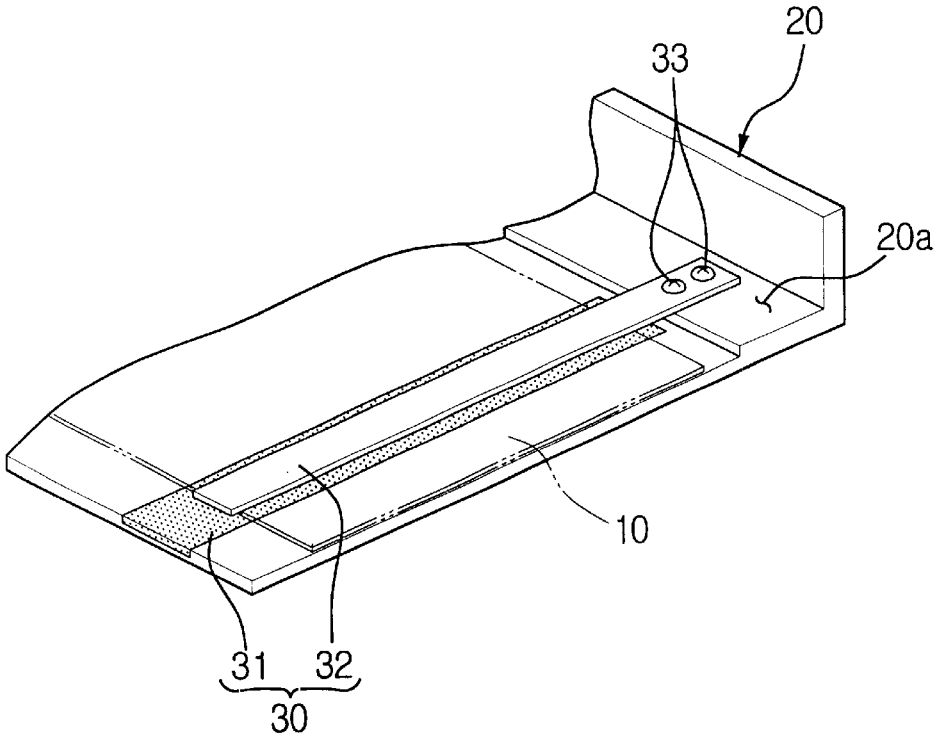
FIG.5 (PRIOR ART)
FIG.5 is a perspective view for showing a fixture structure of a photosensitive supporting section and a plate member of the conventional photo sensitive belt cartridge.

In the photosensitive belt cartridge constructed as above, as described above, the photosensitive belt 10 is supported and accommodated by a plurality of spring plates 300 and the inner cover 400. Further, when replacing the photosensitive belt 10 of the printer, the user opens the front door of the printer, discards the used photosensitive belt 10, aligns and then pushes the guiding rail 230 of the photosensitive belt cartridge along the advancing rails of the belt unit. At this time, the steering roll 13 of the belt unit is moved to the position indicated by the dotted line of FIG. 1. The steering roll 13 is returned to its original position after the user completely advances the photosensitive belt cartridge into the printer body. Accordingly, when pulling out the photosensitive belt cartridge, the photosensitive belt 10 accommodated in the photosensitive belt cartridge is locked by the rollers of the belt unit and stays in the printer body. Here, as the photosensitive belt cartridge is advanced, the inner cover 400 is slid into the cartridge until the inner cover 400 comes into tight contact with the lowest inner portion of the cartridge.

Further unique features of the present invention that cannot be obtained by the conventional cartridge, are described below.

The photosensitive belt cartridge of the liquid electrophotographic printer according to the present invention has a reduced number of parts, and a structure in which the cartridge body 200 and the spring plates 300 are assembled with each other by fitting with a minimum number of screws and clips. Accordingly, the structure is simplified, and assembling time and manufacturing cost can be significantly reduced. In view of the above, the photosensitive belt cartridge according to the present invention has many manufacturing benefits over those of a conventional cartridge.

Further, since the photosensitive belt cartridge according to the present invention includes a simple structured guiding rail 230 and handle, with rounded edges, it is easier to handle, and does not harm users or damage the photosensitive belt 10.

Further, in the photosensitive belt cartridge according to the present invention, the open portion of the cartridge body 200 is blocked by the inner cover 400 thereby supporting the cartridge body 200 and photosensitive belt 10, the deformation of the cartridge body 200, and partial deformation by the loosening of the photosensitive belt 10 can be prevented. Also, since the present invention does not employ any magnets, the products can be easily assembled, while the quality deterioration of the photosensitive belt 10 due to the magnets can be prevented.

As stated above, the preferred embodiment of the present invention is shown and described. Although the preferred embodiment of the present invention has been described, it is understood that the present invention should not be limited to this preferred embodiment but various changes and modifications can be made by one skilled in the art within the spirit and scope of the present invention as hereinafter claimed.

What is claimed is:

1. A photosensitive belt cartridge accommodating a photosensitive belt mounted in a liquid electrophotographic printer, comprising:

a cartridge body, substantially in the shape of an ovoid with an open portion, the cartridge body including an endless track for holding the photosensitive belt before insertion of the photosensitive belt cartridge into a belt unit of the printer;

a plurality of spring plates, each of said spring plates having a first end fixed on an inner wall of the cartridge body, the plurality of spring plates being arranged on the inner wall of the cartridge body at certain intervals, for supporting the photosensitive belt on the endless track in cooperation with the inner wall of the cartridge body; and an inner cover for supporting edges of the photosensitive belt and also for supporting a second end of the plurality of spring plates, for preventing partial loosening of the photosensitive belt.

2. The photosensitive belt cartridge as claimed in claim 1, wherein the cartridge body is assembled in a manner that a certain size plate-shaped member is curved until two opposite ends of said plate-shaped member meet to form a hollow space therein, and then a joint made by the two opposite ends is fixed by clips, the cartridge body comprising a handle formed opposite to the open portion for a user to grasp the cartridge, and edges of the cartridge body are rounded.

3. The photosensitive belt cartridge as claimed in claim 1, wherein the cartridge body comprises a guiding rail formed on an upper surface, which has a pair of outwardly-bent locking ribs that are slidably fit into an advancing rail of the belt unit of the electrophotographic printer.

4. The photosensitive belt cartridge as claimed in claim 3, wherein the guiding rail further comprises an inwardly-bent guiding section for easy advancement into the advancing rail of the belt unit.

5. The photosensitive belt cartridge as claimed in claim 1, wherein the inner cover comprises guiding grooves corresponding to a shape of the spring plates, and supporting protrusions protruding from a middle portion of the guiding grooves for supporting the spring plates.

6. The photosensitive belt cartridge as claimed in claim 1, wherein the inner cover comprises at least six hooks spaced from each other at certain intervals and said hooks are inserted into a plurality of holes formed along the open portion of the cartridge body, for preventing a complete separation of the inner cover from the cartridge body.

7. The photosensitive belt cartridge as claimed in claim 1, wherein the inner cover slides into the cartridge body when the photosensitive belt cartridge is inserted into the belt unit of the printer.

* * * * *